US007878168B2

(12) United States Patent
Hayman et al.

(10) Patent No.: US 7,878,168 B2
(45) Date of Patent: Feb. 1, 2011

(54) HIGH PERFORMANCE OVERHEAD VALVETRAIN ASSEMBLY

(75) Inventors: Alan W. Hayman, Romeo, MI (US); Robert S McAlpine, Lake Orion, MI (US); Eric C. Douse, Pontiac, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 526 days.

(21) Appl. No.: 11/940,809

(22) Filed: Nov. 15, 2007

(65) Prior Publication Data

US 2008/0196683 A1 Aug. 21, 2008

Related U.S. Application Data

(60) Provisional application No. 60/901,780, filed on Feb. 16, 2007.

(51) Int. Cl.
*F01L 1/18* (2006.01)

(52) U.S. Cl. ..... 123/90.45; 123/90.16; 123/90.39; 123/90.52; 74/569

(58) Field of Classification Search ..... 123/90.39, 123/90.44, 90.16, 90.27, 90.45, 90.48, 90.5, 123/90.52

See application file for complete search history.

(56) References Cited

U.S. PATENT DOCUMENTS 5,680,838 A 10/1997 See
5,697,333 A * 12/1997 Church et al. ..... 123/90.16
6,505,589 B1 1/2003 Hayman

FOREIGN PATENT DOCUMENTS

CN 1873191 A 12/2006
EP 0733783 A1 9/1996

* cited by examiner

*Primary Examiner*—Ching Chang

(57) ABSTRACT

A high performance overhead valvetrain assembly includes a hydraulic lash adjuster which is received within and supports a trunnion. The trunnion, in turn, is received within a cylindrical passageway in one end of a rocker arm. The opposite end of the rocker arm engages a valve stem. Between the trunnion and the valve stem is a roller adapted the engage a cam of a camshaft. The trunnion stabilized rocker arm permits significantly increased valve lift and improved engine performance.

19 Claims, 5 Drawing Sheets

(SECTION A-A)

(SECTION A-A)

HIGH PERFORMANCE OVERHEAD VALVETRAIN ASSEMBLY

CROSS-REFERENCE TO RELATED APPLICATIONS

The present application claims the benefit of U.S. Provisional Application No. 60/901,780 filed on Feb. 16, 2007. The disclosure of the above provisional application is incorporated herein by reference.

BACKGROUND

The invention relates generally to overhead valve train assemblies and more particularly to overhead valvetrain assemblies having stabilized rocker arms.

In many conventional overhead valvetrain configurations, one end of a rocker arm engages a lash adjuster, the opposite end engages a valve stem and a roller or other friction reducing device in the middle of the rocker arm engages the camshaft. So configured, there is no fixed axis about which the rocker arm pivots and thus the rocker arm cannot be stabilized by being mounted on a shaft. Rather, the rocker arm must be and is maintained in its proper position by cooperation between a convex, hemispherical feature on the lash adjuster and a complementary concave, hemispherical feature on the rocker arm. This mounting arrangement has not always proven to be satisfactory as side loads on the assembly may result in the rocker arm moving out of its desired, operating position. Additionally, there are inherent limits to rocker arm rotation and valve lift which, if exceeded, will again result in the rocker arm moving out of position.

From the foregoing discussion, it is apparent that improvements in the art of overhead valvetrains and lash adjusters are desirable.

SUMMARY

The present invention encompasses a high performance overhead valvetrain assembly which has a rocker arm pivotally supported on a trunnion which, in turn, is supported by a hydraulic lash adjuster. The end of the rocker arm opposite the trunnion engages a valve stem. Between the trunnion and the valve stem is a roller which engages a cam on a camshaft. In a second embodiment, the hydraulic lash adjuster is replaced by a fixed post and lash is adjusted by shims or lash caps of varying thickness. In a third embodiment, the hydraulic lash adjuster is utilized and includes a sliding element disposed within a sleeve that engages the ball of the adjuster. The sliding element permits relative radial motion between the adjuster and the sleeve to accommodate differences in concentricity between the ball of the adjuster and the bore of the cylinder head. The trunnion stabilized rocker arm according to the present invention permits significantly increased valve lift and improved engine performance.

Thus it is an object of the present invention to provide an overhead valvetrain assembly having a hydraulic lash adjuster and rocker arm having a supporting trunnion and camshaft engaging roller.

It is a further object of the present invention to provide an overhead valvetrain assembly having a stabilized rocker arm including a trunnion mounted upon a lash adjuster.

It is still further object of the present invention to provide an overhead valvetrain having a solid support post for a trunnion pivotally supporting a rocker arm where lash is adjusted by shims or lash caps.

Further objects, advantages and applicatioons of the present invention will become apparent by reference to the following description and appended drawings wherein like reference numbers refer to the same component, element or feature.

DESCRIPTION OF THE PREFERRED AND ALTERNATE EMBODIMENTS

Figure 1:
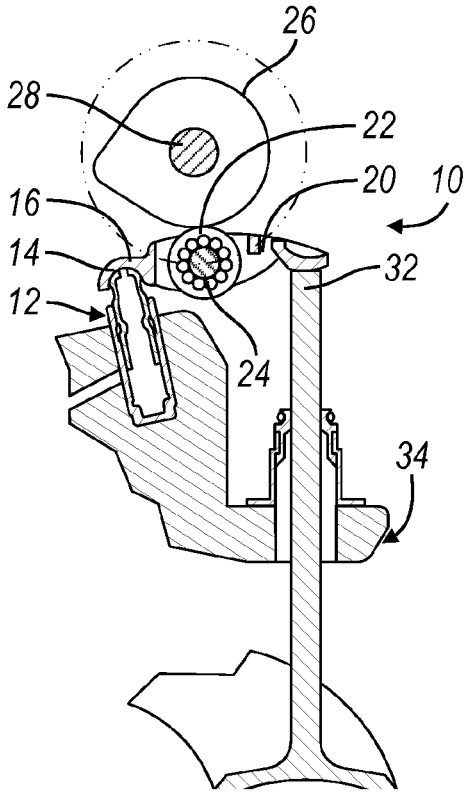
FIG. 1 (PRIOR ART)
FIG. 1 is a full, sectional view illustrating a typical prior art overhead valve train utilized in an internal combustion engine.

Referring now to FIG. 1, a typical prior art valvetrain assembly is illustrated and designated by the reference number 10. The prior art valvetrain assembly 10 includes a hydraulic lash adjuster 12 having a hemi-spherical terminal portion 14 which is received within a complementary hemispherical socket 16 disposed at one end of a rocker arm 20. The rocker arm 20 also includes a cam follower 22 supported by an antifriction bearing such as a roller or ball bearing 24. The cam follower 22 engages a cam 26 on an overhead camshaft 28 in accordance with conventional practice. At the end of the rocker arm 20 opposite the lash adjuster 12 and in contact with the rocker arm 20 is a stem portion 32 of a valve 34. It will be appreciated that in this prior art valvetrain configuration, the rocker arm 20 is restrained in its operating position primarily by cooperation between the hemispherical terminal portion 14 of the hydraulic lash adjuster 12 and the complementary hemispherical socket 16 of the rocker arm 20. This mounting arrangement can impose a limit on the speed of the engine and limit the extent of valve travel or lift.

Figure 2:
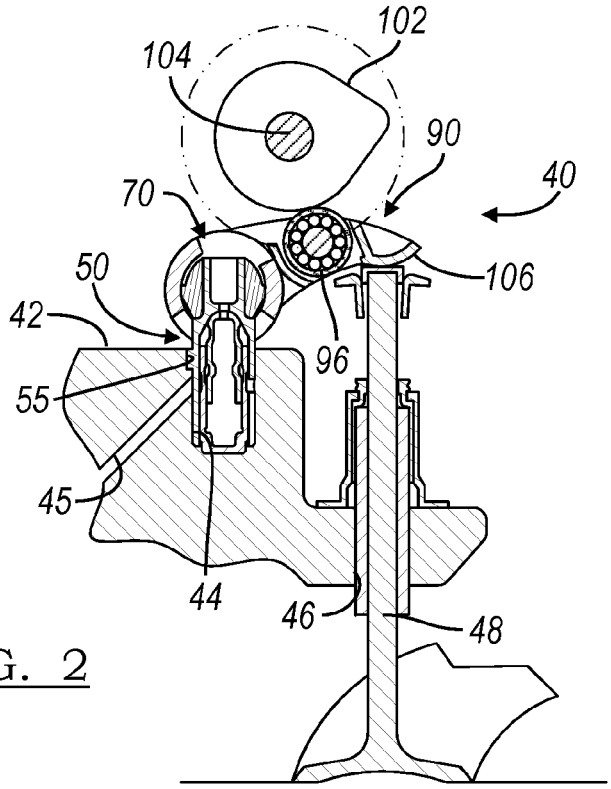
FIG. 2 is a full, sectional view of an overhead valvetrain assembly according to a first embodiment of the present invention in an internal combustion engine.

Referring now to FIG. 2, a first embodiment of an overhead valvetrain assembly 40 according to the present invention is illustrated and designated by the reference number 40. The overhead valvetrain assembly 40 is illustrated in an exemplary cylinder head 42 which includes a blind bore 44 which communicates with a supply of pressurized oil (not illustrated) through a passageway 45. The blind bore 42 receives a hydraulic lash adjuster assembly 50. The cylinder head 42 also defines an elongate passageway 46 which slidably receives a stem of an intake or exhaust valve 48. The end of the hydraulic lash adjuster assembly 50 extending beyond the cylinder head 42 is received within a trunnion 70 which, in turn, is rotatably received within a rocker arm assembly 90.

Figure 3:
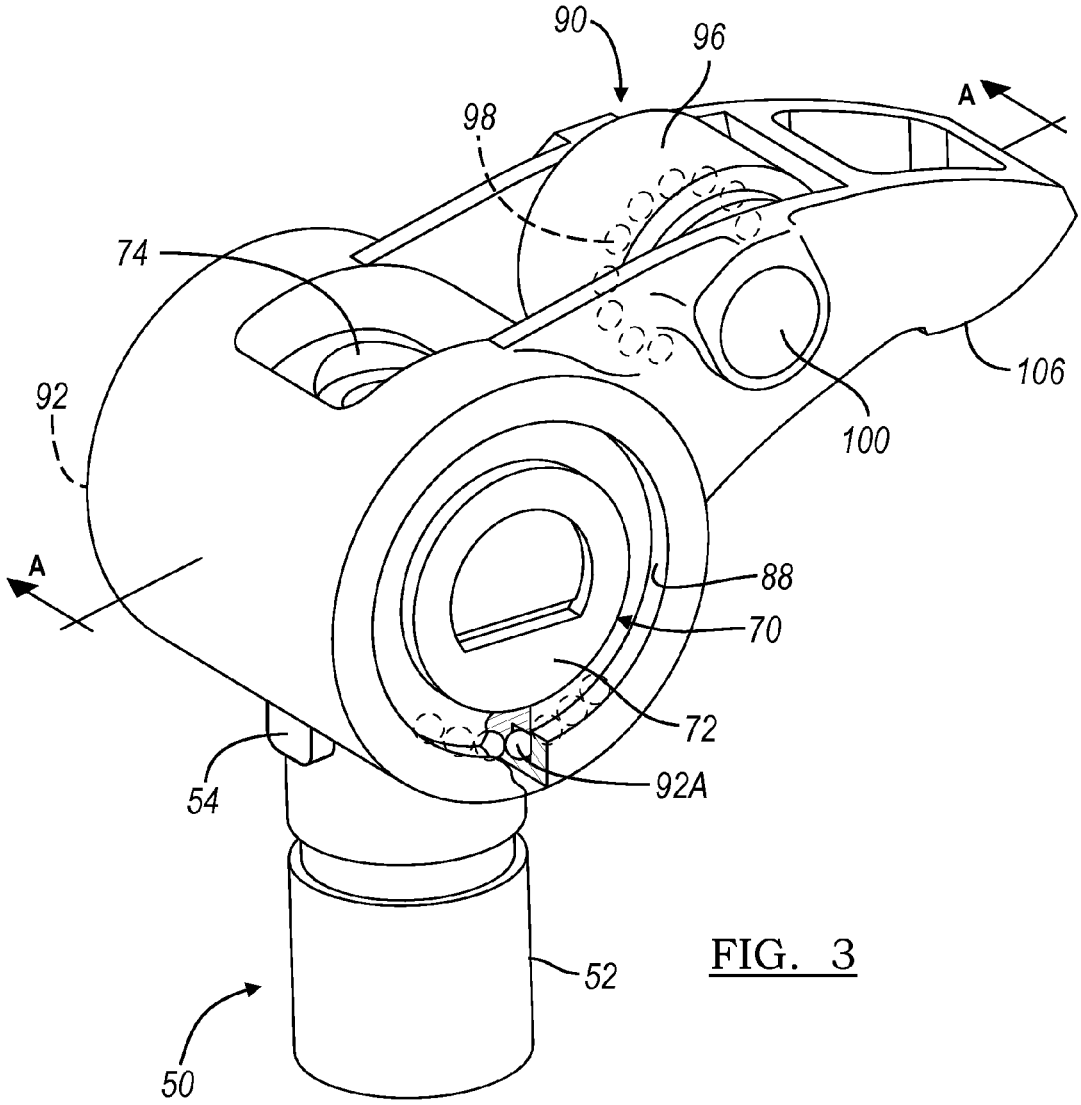
FIG. 3 is a perspective view of a rocker arm and lash adjuster according to the first embodiment of the present invention having a trunnion supported on ball bearing assemblies.
Figure 4A:
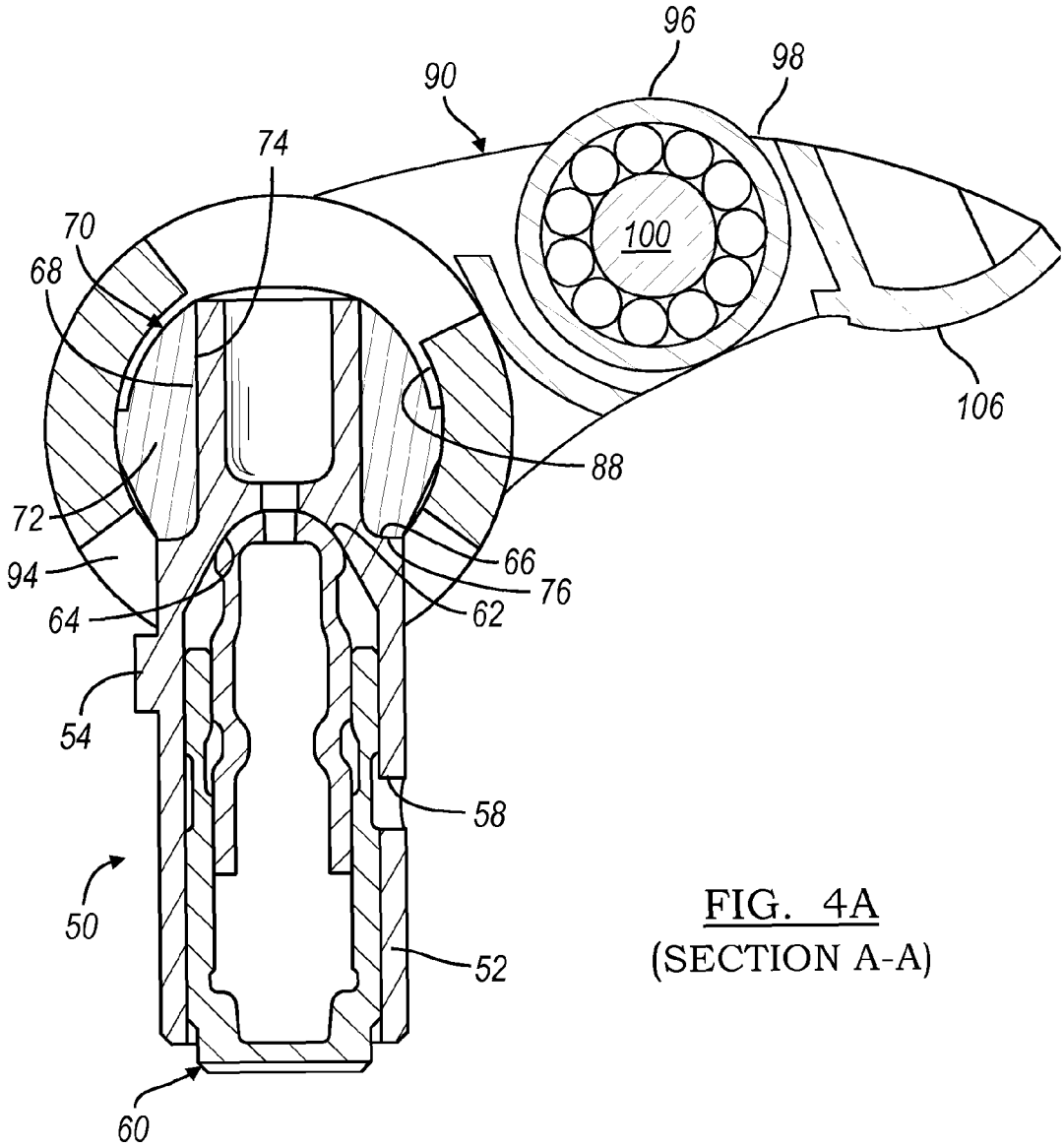
FIG. 4A is a full, sectional view of a rocker arm and lash adjuster according to the first embodiment of the present invention taken along line A-A of FIG. 3.

Referring now to FIGS. 2, 3 and 4A, the hydraulic lash adjuster assembly 50 includes a outer shell or sleeve 52 which is slidably received within the blind bore 44 of the cylinder head 42. The shell or sleeve 52 includes a radially projecting alignment pin or dowel 54 which is received within a complementary axial channel or slot 55 in the side wall of the blind bore 44. As will be appreciated, cooperation between the dowel 54 and the axial channel 55 in the blind bore 44 inhibits rotation of the outer shell or sleeve 52 relative to the cylinder head 42. A radial passageway 58 in the outer shell or sleeve 52 communicates with the hollow interior of the outer shell or sleeve 52 in which is disposed a conventional hydraulic lash adjuster 60. A hemispherical terminal portion 62 of the lash adjuster 60 is received within a complementary hemi-spherical socket 64 within the shell or sleeve 52. The exterior of the shell or sleeve 52 includes a shoulder 66 which defines a smaller diameter, terminal portion 68.

The trunnion 70 defines a cylindrical body 72 having a through, radially oriented circular opening or bore 74 which securely receives by, for example, an interference fit or other attachment means, the terminal portion 68 of the shell or sleeve 52 of the lash adjuster assembly 50. The cylindrical body 72 of the trunnion 70 also defines a flat shoulder 76 extending about the opening or bore 74 which contacts the shoulder 66 on the sleeve 52 when the two components are assembled.

The trunnion 70 is received within a transverse cylindrical passageway 88 in the rocker arm assembly 90. A pair of anti-friction ball bearing assemblies 92A, one of which is illustrated in FIG. 3, are disposed between each end of the trunnion 70 and the cylindrical passageway 88 in the rocker arm assembly 90. The ball bearing assemblies 92A may be replaced by other types of antifriction bearings or journal bearings as described below. The rocker arm assembly 90 includes at least one opening 94 which receives the shell or sleeve 52 of the hydraulic lash adjuster assembly 50 and allows rotation of the trunnion 70 and the lash adjuster assembly 50 within the passageway 88 of the rocker arm assembly 90. The rocker arm assembly 90 also supports a cam roller 96 preferably including an antifriction ball or roller bearing assembly 98 supported on a stub shaft 100.

As illustrated in FIG. 2, in accordance with conventional practice, the cam roller 96 is engaged by a rotating cam 102 on an overhead camshaft 104. The end of the rocker arm assembly 90 opposite the hydraulic lash adjuster assembly 50 includes a surface 106 which engages the terminal portion of the stem of the valve 48.

Figure 4B:
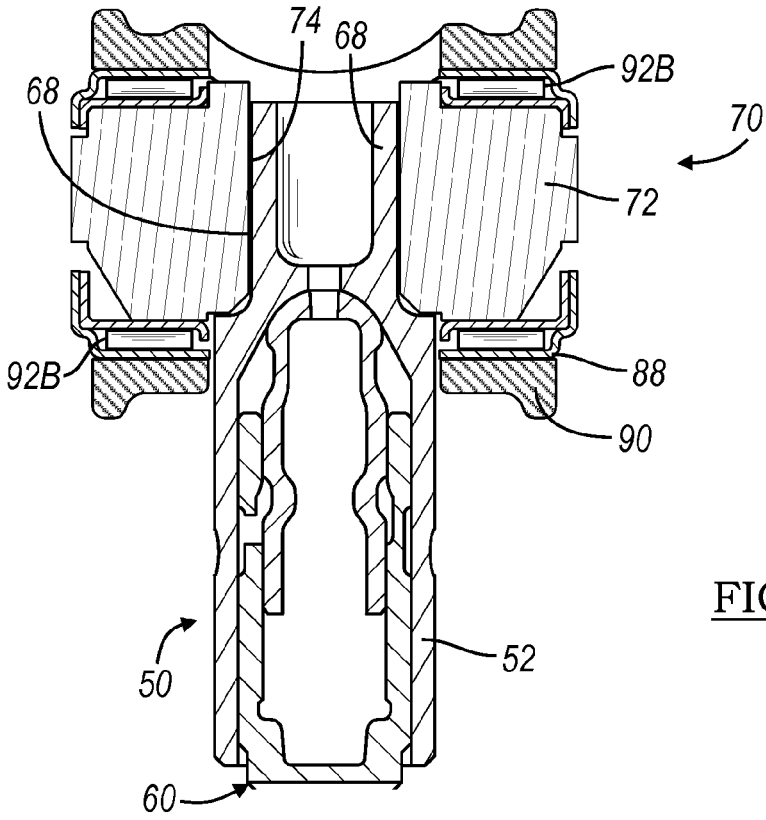
FIG. 4B is a full, sectional view of a rocker arm and lash adjuster according to the first embodiment of the present invention having roller bearing assemblies.

Referring now to FIG. 4B, an alternate bearing arrangement, noted above, in which the cylindrical body 72 of the trunnion 70 is supported within the passageway 88 of the rocker arm assembly 90 by a pair of roller bearing assemblies 92B, is illustrated. The roller bearing assemblies 92B provide improved stability of the rocker arm assembly 90. Other components of the embodiment, such as the lash adjuster assembly 50, the shell or sleeve 52 having a terminal portion 68 which is received within the opening or bore 74 of the trunnion 70, the hydraulic lash adjuster 60 and the rocker arm assembly 90 are the same.

Figure 4C:
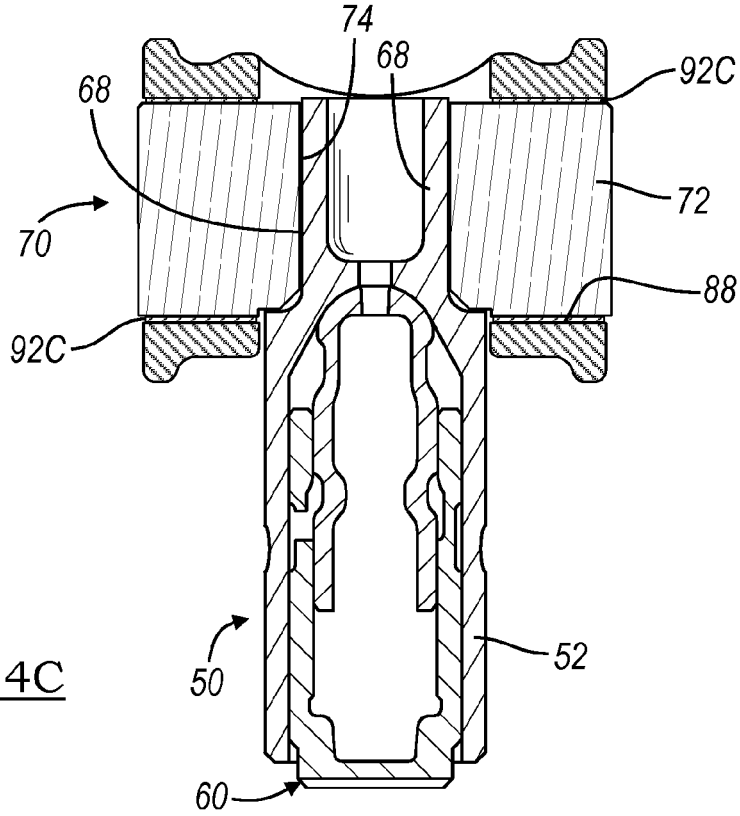
FIG. 4C is a full, sectional view of a rocker arm and lash adjuster according to the first embodiment of the present invention having journal bearings with hardened or treated surfaces.

Referring now to FIG. 4C, another alternate bearing arrangement, noted above, in which the cylindrical body 72 of the trunnion 70 is supported within the passageway 88 of the rocker arm assembly 90 by a pair of journal bearings 92C, is illustrated. Preferably, the exterior surface of the cylindrical body 88 of the trunnion 90 is hard coated with a surface treatment that exhibits increased hardness and reduced friction. Alternatively, the surface of the passageway 88 of the rocker arm assembly 90 or both surfaces may be hard coated. Other components of the embodiment, such as the lash adjuster assembly 50, the shell or sleeve 52 having a terminal portion 68 which is received within the opening or bore 74 of the trunnion 70, the hydraulic lash adjuster 60 and the rocker arm assembly 90 are the same. It will be appreciated that although illustrated in conjunction with the first embodiment 40 of the invention, all three bearing arrangements, i.e., ball or roller bearing assemblies or journal bearings, are equally suitable for use in the second and third embodiments of the invention.

Figure 5:
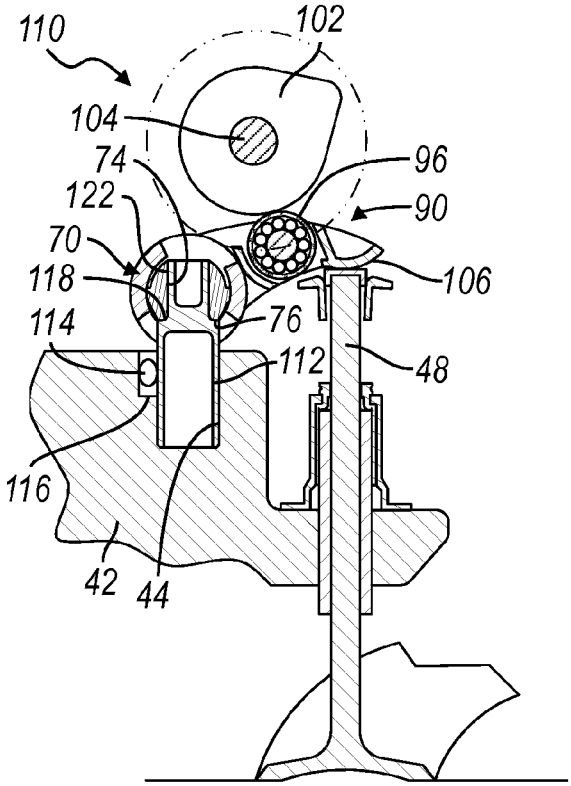
FIG. 5 is a full, sectional view of an overhead valvetrain assembly according to a second embodiment of the present invention.

Referring now to FIG. 5, a second embodiment of a valvetrain assembly according to the present invention is illustrated and designated by the reference number 110. The second embodiment valvetrain assembly 110 is associated with a cylinder head 42, an intake or exhaust valve 48 and a rotating cam 102 on a camshaft 104. The second embodiment valvetrain assembly 110 includes a trunnion 70 having a flat shoulder 76 which is received within a rocker arm assembly 90 having a cam roller 96 and a valve stem engaging surface 106.

Distinct in the second embodiment valvetrain assembly 110 is a solid, cylindrical stanchion or post 112 which is received within the blind machined bore 44 in the cylinder head. The exterior surface of the stanchion or post 112 includes a radially projecting pin or dowel 114 which is received within an axial slot or channel 116 in the sidewall of the machined bore 44 to inhibit rotation of the stanchion or post 112. The stanchion or post 112 includes a flat shoulder 118 which defines a reduced diameter portion 122. The reduced diameter portion 122 of the stanchion or post 112 is received and secured, preferably by an interference fit, in the opening or bore 74 in the trunnion 70 and the flat shoulder 118 engages the shoulder 76 of the trunnion 70 when the two components are assembled.

It should be appreciated that the solid stanchion or post 112 is incapable of providing lash adjustment. Instead, lash adjustment is achieved by utilizing shims or lash caps (not illustrated) of varying thickness which are disposed between the end of the valve 48 and the surface 106 of the rocker arm assembly 90. The second embodiment valvetrain assembly 110 provides a stiffer valvetrain assembly for very high performance engines such as racing engines and similar applications in which automatic lash adjustment, i.e., lash adjustment provided by, for example, a hydraulic lash adjuster, is neither necessary nor required.

Figure 6:
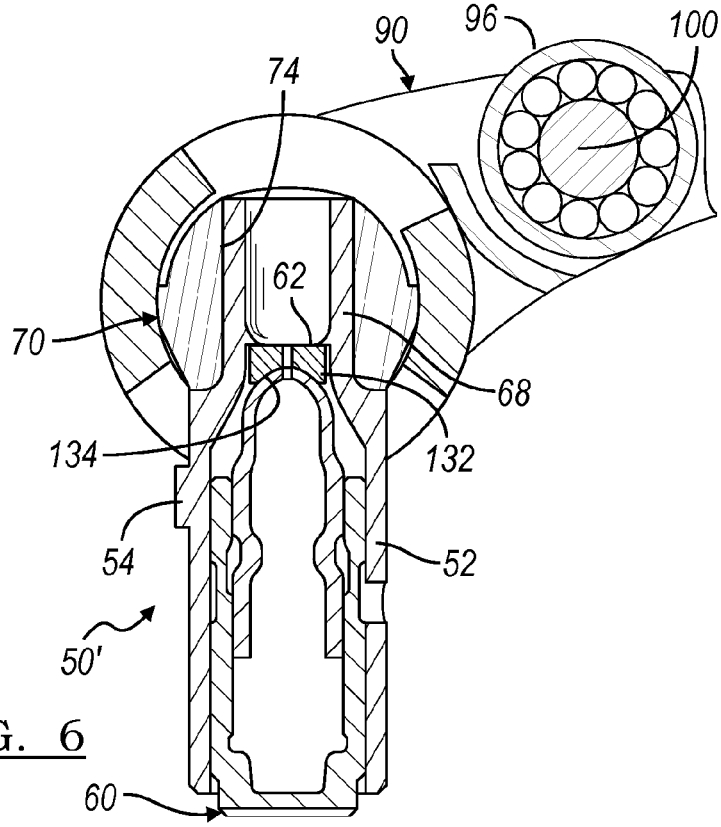
FIG. 6 is a fragmentary, sectional view of an overhead valvetrain assembly according to a third embodiment of the present invention.

Referring now to FIG. 6, a third embodiment valvetrain assembly 130 is illustrated. The third embodiment valvetrain assembly 130 is the similar to the first embodiment valvetrain assembly 40 in most respects in that it includes a hydraulic lash adjuster assembly 50', the trunnion 70 and the rocker arm assembly 90. Additionally, the third embodiment valvetrain assembly 130 includes a transversely sliding element or disc 132 in the throat of the shell or sleeve 52 having a hemispherical socket 134 that engages the hemispherical terminal portion 62 of the hydraulic lash adjuster 60. The element or disc 132 allows for relative radial motion between the lash adjuster 60 and the shell or sleeve 52 to accommodate any difference in concentricity between the hemi-spherical terminal portion 62 of the lash adjuster 60 and the bore 44 in the cylinder head 42. The element or disc 132 applies the load to the throat of the shell or sleeve 52 and thence to the trunnion 70 to eliminate the lash in the valvetrain.

While the best mode for carrying out the invention have been described in detail, it is to be understood that the terminology used is intended to be in the nature of words and description rather than of limitation. Those familiar with the art to which this invention relates will recognize that many modifications of the present invention are possible in light of the above teachings. It is, therefore, to be understood that within the scope of the appended claims, the invention may be practiced in a substantially equivalent way other than as specifically described herein.

The description of the embodiments of the present invention are merely exemplary in nature and variations that do not depart from the gist of the invention are intended to be within the scope of the invention. Such variations are not to be regarded as a departure from the spirit and scope of the invention.

We claim:

1. An overhead valvetrain assembly comprising in combination, a lash adjuster assembly having a pair of ends and an alignment pin, wherein said alignment pin extends from said lash adjuster assembly, a trunnion having a transverse opening for receiving one of said ends of said lash adjuster, and a rocker arm defining a passageway for receiving said trunnion, a cam follower rotatably disposed in said rocker arm and a surface for engaging and translating a valve.

2. The overhead valvetrain assembly of claim 1 further including anti-friction bearings disposed in said passageway between said trunnion and said rocker arm.

3. The overhead valvetrain assembly of claim 1 wherein said trunnion defines an outer surface and said outer surface is hard coated.

4. The overhead valvetrain assembly of claim 1 further including an antifriction bearing in said cam follower and a stub shaft in said antifriction bearing.

5. The overhead valvetrain assembly of claim 1 wherein said lash adjuster assembly includes an outer cylindrical housing defining said one of said ends and an interior region and a hydraulic lash adjuster disposed in said interior region.

6. The overhead valvetrain assembly of claim 1 wherein said lash adjuster assembly includes a stanchion.

7. An improved valvetrain assembly comprising, in combination, a rocker arm having a first end adapted to engage a valve stem, a second end defining a transverse passageway, a cam follower rotatably supported between said ends, a trunnion disposed in said passageway and defining a radial opening, a support received within said radial opening of said trunnion, and a hydraulic lash adjuster received within said support, wherein said support is a sleeve for receiving said hydraulic lash adjuster, and wherein said support is configured to be slidably received by a cylinder head.

8. The improved valvetrain assembly of claim 7 wherein said support includes means for inhibiting rotation.

9. The improved valvetrain assembly of claim 8 wherein said trunnion defines an outer surface, said passageway defines an inner surface and one of said surfaces is hard coated.

10. The improved vavletrain assembly of claim 7 further including a stub shaft mounted to said rocker arm and an antifriction bearing disposed on said stub shaft and rotatably supporting said cam follower and wherein said passageway and said stub shaft define parallel, spaced-apart axes.

11. The improved valvetrain assembly of claim 7 further including anti-friction bearings disposed in said passageway between said trunnion and said rocker arm.

12. The improved valvetrain assembly of claim 7 wherein said support defines a fixed length.

13. The improved valvetrain assembly of claim 7 further including a hydraulic lash adjuster disposed in said support and a moveable element disposed between said lash adjuster and said support.

14. A high performance valvetrain assembly comprising, in combination, a support member adapted for disposition in a cylinder head, wherein said support member has an engageable end, a hydraulic lash adjuster received by said support member, wherein said support member is a sleeve for receiving said hydraulic lash adjuster;

a trunnion defining an axis of rotation and a radially oriented opening receiving said engageable end of said support member, and a rocker arm having an opening for receiving said trunnion, a surface adapted to engage an end of a valve and a cam follower rotatably mounted to said arm between said opening and said surface.

15. The high performance valvetrain assembly of claim 14 wherein said support member is a stanchion.

16. The high performance valvetrain assembly of claim 14 wherein said support member includes means for inhibiting rotation of said support member relative to the cylinder head.

17. The high performance valvetrain assembly of claim 14 further including an antifriction bearing disposed in said cam follower and a stub shaft disposed in said bearing and mounted in said arm.

18. The high performance valvetrain assembly of claim 14 further including anti-friction bearings disposed in said passageway between said trunnion and said arm.

19. The high performance valvetrain assembly of claim 14 wherein said trunnion defines an outer surface, said opening defines an inner surface and one of said surfaces is hard coated.

* * * * *